US012790972B2

(12) United States Patent
Haberle et al.

(10) Patent No.: US 12,790,972 B2
(45) Date of Patent: Nov. 10, 2026

(54) CONNECTION UNIT

(71) Applicant: Purem GmbH, Neunkirchen (DE)

(72) Inventors: Jürgen Haberle, Stuttgart (DE); Adam Karch, Kirchheim unter Teck (DE); Michael Krause, Esslingen (DE); Amol Anil Karekar, Esslingen (DE)

(73) Assignee: Purem GmbH, Neunkirchen (DE)

( * ) Notice: Subject to any disclaimer, the term of this patent is extended or adjusted under 35 U.S.C. 154(b) by 0 days.

(21) Appl. No.: 19/188,849

(22) Filed: Apr. 24, 2025

(65) Prior Publication Data

US 2025/0250925 A1 Aug. 7, 2025

Related U.S. Application Data

(63) Continuation of application No. PCT/EP2024/073521, filed on Aug. 22, 2024.

(30) Foreign Application Priority Data

Aug. 22, 2023 (DE) ..... 10 2023 122 361.5

(51) Int. Cl.
*F01N 13/08* (2010.01)
*F01N 3/20* (2006.01)

(52) U.S. Cl.
CPC ..... *F01N 13/08* (2013.01); *F01N 3/20* (2013.01); *F01N 2470/02* (2013.01)

(58) Field of Classification Search
CPC .. F01N 13/08; F01N 13/1861; F01N 13/1872; F01N 2240/14; F01N 2450/22;
(Continued)

(56) References Cited

U.S. PATENT DOCUMENTS 8,117,832 B2 * 2/2012 Wagner ..... F01N 3/0238 60/303
12,012,884 B1 * 6/2024 Zeller ..... F01N 3/2033
(Continued)

FOREIGN PATENT DOCUMENTS

DE 90 14 660 U1 1/1991
DE 43 07 525 A1 9/1994
(Continued)

OTHER PUBLICATIONS

International Search Report of the European Patent Office dated Oct. 28, 2024 for international application PCT/EP2024/073521 on which this application is based.
(Continued)

*Primary Examiner* — Anthony Ayala Delgado
(74) *Attorney, Agent, or Firm* — Walter Ottesen, P.A.

(57) ABSTRACT

A connection unit connects a heating gas generating arrangement to an exhaust gas conducting component of an exhaust system for an internal combustion engine. The heating gas generated is introduceable into an exhaust duct in the exhaust gas conducting component. The connection unit includes: a connection unit body defining a center axis and being formed integrally with: a circumferential wall surrounding a heating duct; a fastening region for fastening to a component wall of the exhaust gas conducting component; and, a connection region for connecting the heating gas generating arrangement to the connection unit. The fastening region includes a flange protruding radially outward from the wall with respect to the center axis and having a fastening surface formed on the flange. The connection region includes a connection flange protruding radially outward from the wall with respect to the center axis and having a connection surface formed on the connection flange.

12 Claims, 3 Drawing Sheets

(58) Field of Classification Search
CPC ..... F01N 2470/02; F01N 3/025; F01N 3/20; F01N 3/2033
See application file for complete search history.

(56) References Cited

U.S. PATENT DOCUMENTS

| | | | | |
|---|---|---|---|---|
| 12,516,617 | B2 * | 1/2026 | Rossi | F01N 3/0253 |
| 2010/0012292 | A1 | 1/2010 | Yamazaki | |
| 2013/0276437 | A1 * | 10/2013 | Iwasaki | F01N 3/103 60/303 |
| 2014/0373821 | A1 * | 12/2014 | Kitagawa | F01M 11/08 123/572 |
| 2016/0032808 | A1 * | 2/2016 | Kobe | F01N 13/08 29/890 |
| 2018/0355777 | A1 * | 12/2018 | Stanavich | F01N 3/025 |
| 2021/0222605 | A1 | 7/2021 | Kurpejovic | |
| 2024/0125260 | A1 * | 4/2024 | Sailer | F01N 3/2033 |

FOREIGN PATENT DOCUMENTS

| | | | |
|---|---|---|---|
| DE | 10 2010 049 018 | A1 | 4/2012 |
| DE | 10 2015 200 196 | A1 | 7/2016 |
| DE | 10 2020 101 134 | A1 | 7/2021 |
| DE | 10 2022 116 939 | A1 | 1/2024 |

OTHER PUBLICATIONS

English translation and Written Opinion of the International Searching Authority dated Oct. 28, 2024 for International application PCT/EP2024/073521 on which this application is based.

* cited by examiner

CONNECTION UNIT

CROSS-REFERENCE TO RELATED APPLICATIONS

This application is a continuation application of international patent application PCT/EP2024/073521, filed Aug. 22, 2024, designating the United States and claiming priority from German application 10 2023 122 361.5, filed Aug. 22, 2023, and the entire content of both applications is incorporated herein by reference.

TECHNICAL FIELD

The present disclosure relates to a connection unit for connecting a heating gas generating arrangement for generating heating gas, which is to be introduced into an exhaust gas flow duct in an exhaust gas conducting component of an exhaust system for an internal combustion engine, to the exhaust gas conducting component.

BACKGROUND

In order to reduce the pollutant content in the exhaust gas emitted by an internal combustion engine, exhaust gas treatment units, such as catalytic converters, particulate filters and the like, are used in such exhaust systems. The treatment process generally includes a catalytic reaction, for the carrying out of which the catalytic converter material of such an exhaust gas treatment unit has to be brought to an operating temperature generally in the range of a few 100° C. In particular in the starting phase of the working operation of an internal combustion engine, in which the exhaust gas emitted by the internal combustion engine is at a comparatively low temperature and the various system regions of an exhaust system are also at a comparatively low temperature, in order to keep the period of time in which a catalytic reaction cannot be carried out in an exhaust gas treatment unit because of the temperature being too low as short as possible, it is known to assign heating units to such exhaust gas treatment units. The heating units may, for example, be electrically operated in order to transfer heat to the exhaust gas emitted by the internal combustion engine or to the air introduced into the exhaust system and to transfer this heat to one or more exhaust gas treatment units positioned further downstream.

In an alternative embodiment of a heating unit, the latter may be configured as a heating gas generating arrangement which, in an exothermic reaction, generally in other words in a combustion process or oxidation process, generates an exhaust gas used as a heating gas. The latter can be conducted in an exhaust system through one or more exhaust gas treatment units in order to use the heat transported in the heating gas for heating such exhaust gas treatment units. Since the heating gas generated in such a heating gas generating arrangement can have a temperature of significantly more than 1000° C., very rapid heating of an exhaust gas treatment unit to the temperature required for carrying out the exhaust gas purification reaction can be achieved.

An exhaust system for a two-stroke engine with a heating gas generating arrangement for introducing heating gas into the exhaust gas flow of an internal combustion engine is known from DE 90 14 660 U1. A connection unit by which the heating gas generating arrangement is connected to an exhaust gas conducting component of the exhaust system includes a tubular, curved connection unit body which, in one of its end regions, is connected by welding to an exhaust gas pipe, which provides an exhaust gas conducting component and which also forms an inlet for a catalytic converter following downstream, and, in its other end region, bears the heating gas generating arrangement, which includes a burner.

In an exhaust system for an internal combustion engine known from the German patent application DE 10 2022 116 939 A1, a connection unit provided for connecting a heating gas generating arrangement to an exhaust gas conducting component of the exhaust system is composed of two components. A component of the connection unit that is in the form of a sheet metal formed part provides a fastening region with which the connection unit is fixedly connected by welding to an exhaust gas conducting component of the exhaust system. A component of the connection unit that is in the form of a metal cast part provides the connection region in which a heating gas generating arrangement can be connected to the connection unit. The two components of the connection unit are fixedly connected to each other by welding in connection regions which are substantially cylindrical in shape and are arranged overlapping each other.

SUMMARY

It is an object of the present disclosure to provide a connection unit which is stable under strong mechanical and thermal loading for connecting a heating gas generating arrangement for generating heating gas, which is to be introduced into an exhaust gas flow duct in an exhaust gas conducting component of an exhaust system for an internal combustion engine, to the exhaust gas conducting component.

According to the disclosure, this object is, for example, achieved by a connection unit for connecting a heating gas generating arrangement for generating heating gas, which is to be introduced into an exhaust gas flow duct in an exhaust gas conducting component of an exhaust system for an internal combustion engine, to the exhaust gas conducting component, including a connection unit body formed integrally with:

- a circumferential wall surrounding a heating gas flow duct,
- a fastening region to be fastened to a component wall of the exhaust gas conducting component, and
- a connection region for connecting the heating gas generating arrangement to the connection unit,
- wherein the fastening region includes a fastening flange protruding radially outward from the circumferential wall with respect to a connection unit body center axis and having an annular fastening surface formed on the fastening flange, and the connection region includes a connection flange protruding radially outward from the circumferential wall with respect to the connection unit body center axis and having an annular connection surface formed on the connection flange.

With its integrally formed connection unit body, the connection unit constructed according to the disclosure avoids the need to assemble separate components providing the fastening region on the one hand and the connection region on the other hand to form the connection unit body. This increases the stability of the connection unit and avoids the risk of damage in the region of such a connection of separate components due to heavy mechanical or thermal loading. Since both in the fastening region and in the connection region respective surfaces used for the fastening and the connection are formed on flanges assigned to the regions, an extensive connection unit connection uniformly distributing the occurring loadings is achieved both in the fastening region to an exhaust gas conducting component and in the connection region to the heating gas generating arrangement. In particular, the connection to the heating gas generating arrangement via the connection flange can be made reversible using a connecting clamp or the like, which is also referred to as V band, in a simple, cost-effective, but nevertheless very stable manner.

It should be noted that, for the purposes of the present disclosure, the expression "integrally" is used to indicate that the components mentioned in this connection are produced as one material block and not by assembling separate components. This can be realized, for example, in that the connection unit body is in the form of a metal cast body. The configuration of the connection unit body as a metal cast body affords the further advantage that the connection unit body, in particular also in its fastening region provided for connection to the exhaust gas conducting component, is significantly more stable than, for example, a sheet metal formed part.

If the connection surface is arranged substantially orthogonally with respect to the connection unit body center axis in an upstream end region of the heating gas flow duct, this permits connection of the connection unit in the connection region to a correspondingly shaped connection flange of the heating gas generating arrangement in a simple manner.

If the fastening surface is inclined at an angle different from 90° with respect to the connection unit body center axis in the upstream end region of the heating gas flow duct, in particular taking into consideration the previously mentioned orientation of the connection surface, a mutually angled orientation of these two surfaces is achieved, which contributes to a compact configuration of an exhaust system constructed with such a connection unit and a heating gas generating arrangement. Furthermore, the thus introduced angled position and the accompanying orientation of the heating gas flow duct also makes it possible to introduce the heating gas into the exhaust gas flow in the exhaust gas conducting component in a manner assisting the thorough mixing of heating gas and exhaust gas.

In an advantageous embodiment, it can be provided that the connection surface lies substantially in one plane, or/and in that the fastening surface lies substantially in one plane. In this case, the respective surface is in the form of a substantially uncurved surface, which on the one hand facilitates the production of the connection unit body providing the surface and of the components to be connected to the connection unit body and on the other hand also facilitates the operation for connecting the connection unit body to the components.

In the region of the fastening of the connection unit body to an exhaust gas conducting component, in order to keep the thermal and the mechanical loading as low as possible, it is proposed that a radial distance of the circumferential wall to the connection unit center axis from the connection flange increases in the direction of the fastening flange, or/and in that the connection surface is smaller than the fastening surface. Since, in the region of the fastening surface or of the fastening flange having the latter, on the one hand the mechanical loading exerted by the heating gas generating arrangement is transferred to the exhaust gas conducting component and on the other hand a comparatively strong thermal loading may occur, in particular because of the heating gas, it is particularly advantageous, with the increase in the dimensioning of the circumferential wall or the larger dimensioned fastening surface in the region of the connection unit connection to the exhaust gas conducting component, to introduce as extensive a load distribution as possible.

A defined introduction of the heating gas into the exhaust gas flow with a simultaneously reduced thermal loading can be achieved, for example, in that a heating gas inlet pipe which is connected to the circumferential wall or/and is at least partially surrounded by the circumferential wall and at least partially provides the heating gas flow duct is provided on the connection unit body.

A simply structured, stable construction can also be achieved if the connection unit body is formed integrally with the heating gas inlet pipe. This therefore means that essentially all of the components of the connection unit body, that is, the circumferential wall, the fastening region, the connection region and the heating gas inlet pipe, are provided as one material block which is integrally structured in itself.

To discharge the heating gas in a manner assisting the thorough mixing with the exhaust gas, a plurality of heating gas discharge openings can be formed in the heating gas inlet pipe.

The disclosure furthermore relates to an exhaust system for an internal combustion engine, including:

- an exhaust gas conducting component with a component wall surrounding an exhaust gas flow duct through which internal combustion engine exhaust gas can flow,
- a heating gas generating arrangement for generating heating gas to be introduced into the exhaust gas flow duct,
- a connection unit constructed according to the disclosure for connecting the heating gas generating arrangement to the component wall in such a way that heating gas generated by the heating gas generating arrangement flows through the connection unit into the exhaust gas flow duct.

For stable support of the connection unit on the component wall, it is proposed that the fastening region is arranged with its fastening surface covering an opening edge region of the component wall, the opening edge region surrounding a heating gas inlet opening in the component wall.

The fixed connection of the connection unit to the exhaust gas conducting component or component wall thereof can be achieved, for example, in that the fastening flange is connected to the component wall via a material bond, preferably welding.

The component wall may include a sheet steel formed part, for example, as are also usually used for cost reasons for exhaust gas conducting components in exhaust systems.

For example, the exhaust gas conducting component can provide a deflection housing for deflecting an exhaust gas flow flowing through the exhaust gas flow duct between an upstream connection region and a downstream connection region thereof. In order also to be able to realize the functionality of the exhaust gas purification in the exhaust system, it can furthermore be provided that the exhaust gas conducting component is connected to an upstream exhaust gas treatment unit in the upstream connection region and is connected to a downstream exhaust gas treatment unit in the downstream connection region.

BRIEF DESCRIPTION OF DRAWINGS

The invention will now be described with reference to the drawings wherein.

DETAILED DESCRIPTION

Figure 1:
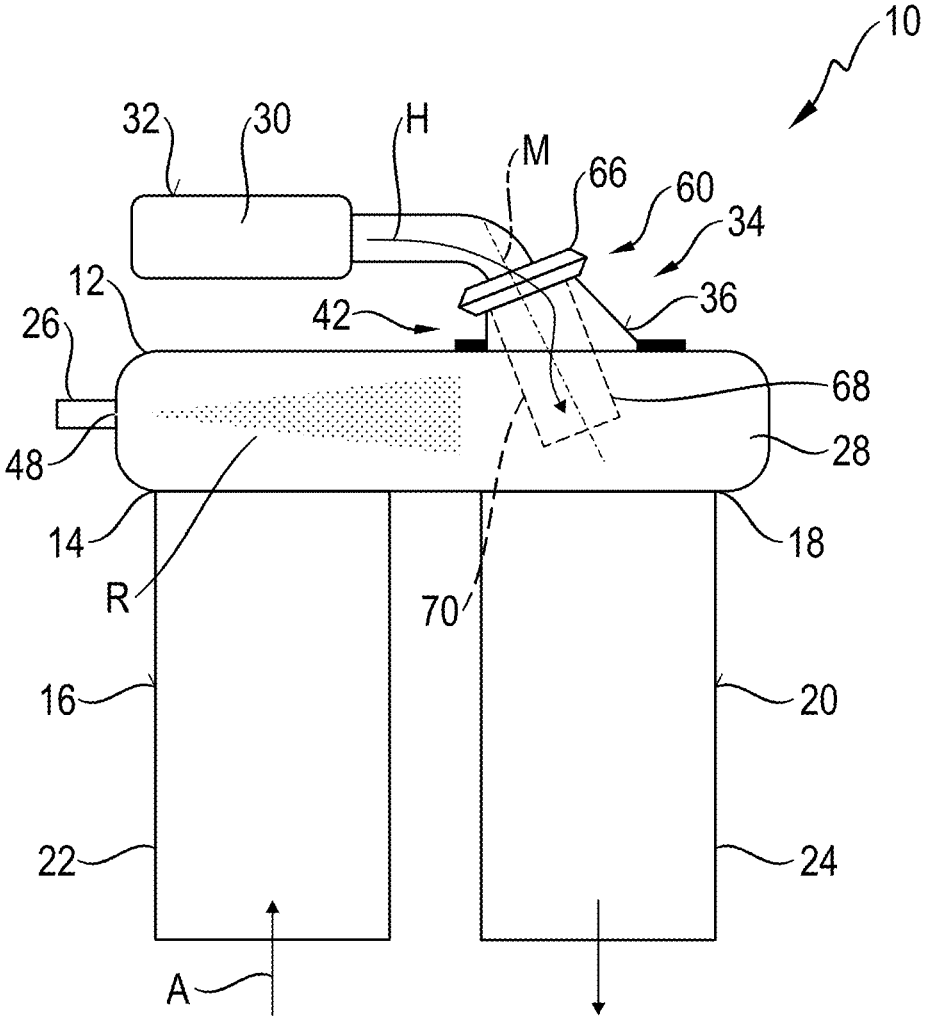
FIG. 1 shows a schematic illustration of an exhaust system having a heating gas generating arrangement and a connection unit connecting the latter to an exhaust gas conducting component.

FIG. 1 schematically illustrates an exhaust system 10 or a part of such an exhaust system 10, in which the internal combustion engine exhaust gas A emitted by an internal combustion engine flows. In the illustrated embodiment, the exhaust system 10 includes an exhaust gas conducting component 12 which is in the form of a deflection housing and in which, as illustrated in FIG. 1, the flow of internal combustion engine exhaust gas A is deflected by about 180°. In an upstream connection region 14 of the exhaust gas conducting component 12, an upstream exhaust gas treatment unit 16 is connected to the exhaust gas conducting component 12. In a downstream connection region 18 of the exhaust gas conducting component 12, a downstream exhaust gas treatment unit 20 is connected to the exhaust gas conducting component.

For example, the upstream exhaust gas treatment unit 16 may include a catalytic converter, such as an oxidation catalytic converter, or/and a particulate filter, carried in a tubular exhaust gas treatment unit housing 22. The downstream exhaust gas treatment unit 20 may, for example, include one or more catalytic converters, for example SCR catalytic converters, carried in an exhaust gas treatment unit housing 24. In this case, an injector 26 may be provided, for example, in the region of the exhaust gas conducting component 12 providing a deflection housing, the injector discharging a reactant R, for example a urea/water solution, into the exhaust gas flow duct 28 provided in the exhaust gas conducting component 12. The reactant R is thoroughly mixed with the internal combustion engine exhaust gas A and flows together with the internal combustion engine exhaust gas A in the direction of the downstream exhaust gas treatment unit 20 in order to carry out the selective catalytic reduction leading to the reduction of the nitrogen oxide content.

The exhaust system 10 furthermore includes a heating gas generating arrangement 32, which includes a burner 30. The burner 30 is fed with combustion air and fuel, for example diesel or gasoline. During the combustion, that is, during an exothermic reaction, combustion exhaust gas is generated which is introduced as heating gas H via a connection unit 34 into the exhaust gas flow duct 28 provided in the exhaust gas conducting component 12. The heating gas H can be at a temperature of up to 1200° C. and can thus contribute to very rapid heating of the downstream system regions of the exhaust system 10, in particular the downstream exhaust gas treatment unit 20.

Figure 2:
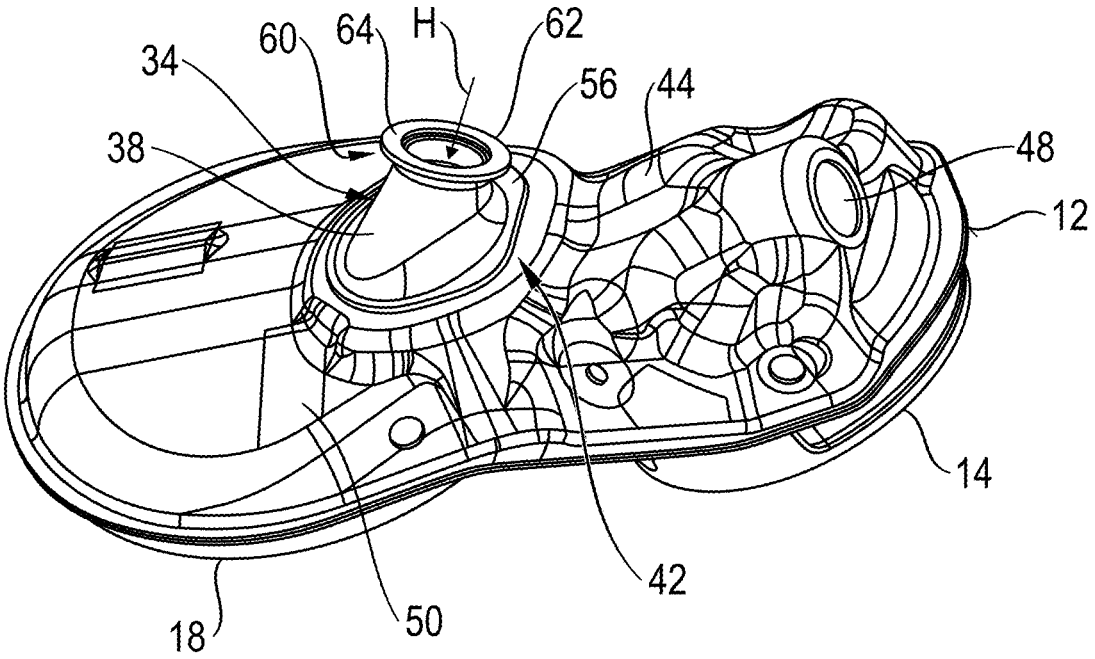
FIG. 2 shows a perspective illustration of the exhaust gas conducting component with the connection unit provided thereon.
Figure 3:
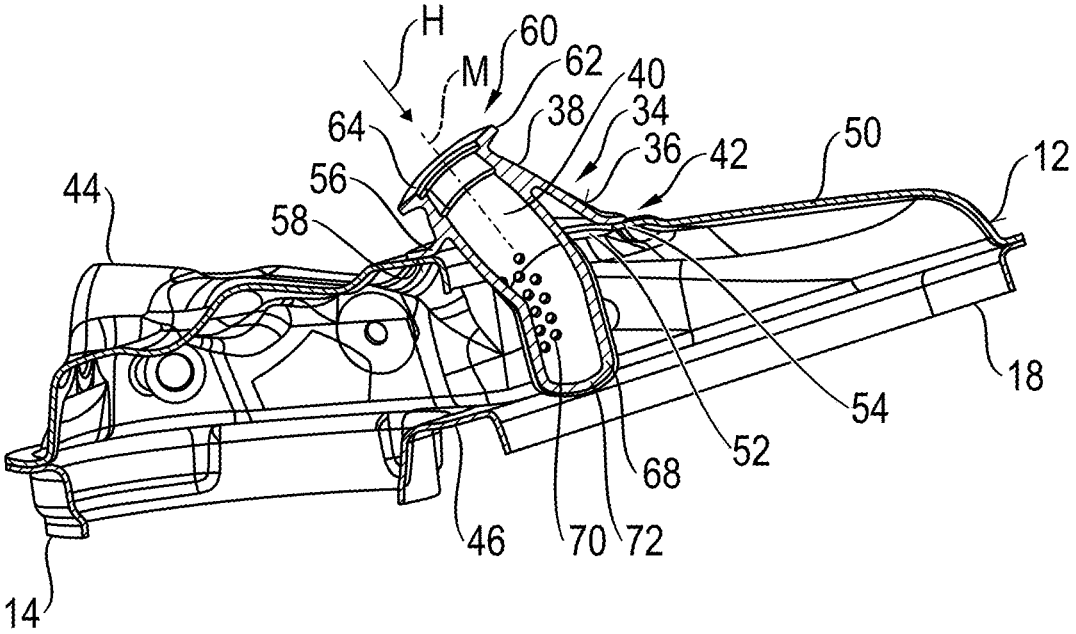
FIG. 3 shows a cross-sectional illustration of the exhaust gas conducting component with the connection unit provided thereon.

With reference to FIGS. 2 and 3, the following in particular describes the construction of the connection unit 34, which, on the one hand, is subject to a strong thermal loading because of the very high temperature of the heating gas H and, on the other hand, is also subject to a strong mechanical loading because of the mechanical coupling, provided by the connection unit, of the heating gas generating arrangement 32 to the exhaust gas conducting component 12.

FIGS. 2 and 3 illustrate that the connection unit 34 is produced integrally, that is, as one material block, for example as a metal cast part in a casting process. A connection unit body 36 of the connection unit 34 includes a circumferential wall 38, which is elongate substantially in the direction of a connection unit body center axis M and surrounds a heating gas flow duct 40. In one of its axial end regions, the circumferential wall 38 merges into a fastening region 42, with which the connection unit 34 is fixed to the exhaust gas conducting component 12.

FIGS. 2 and 3 show that the exhaust gas conducting component 12, which is in the form of a deflection housing, can be constructed, for example, with two housing parts 44, 46 in the form of sheet metal formed parts. The upstream connection region 14 and the downstream connection region 18 are provided on the housing part 46. On the other housing part 44, the injector 26 can be attached in the region of an injector opening 48 provided for it.

The housing part 44 provides a component wall 50 in which a heating gas inlet opening 52 is formed. The heating gas inlet opening 52 is surrounded by an opening edge region 54 which is substantially planar in shape, that is, lies in one plane, and on which a fastening flange 56 of the fastening region 42, which fastening flange protrudes radially outward with respect to the circumferential wall 38, rests with a fastening surface 58. The fastening surface 58 annularly surrounds the connection unit body center axis M and preferably also lies substantially in one plane, that is, is a substantially uncurved surface with which the fastening flange 56 rests continuously on the opening edge region 54 in the circumferential direction around the heating gas inlet opening 52. A fixed connection of the connection unit 34 to the housing part 44 of the exhaust gas conducting component 12 is achieved in that a welded joint, for example, completely surrounding the fastening flange 56 or completely guided in the circumferential direction along the fastening flange 56, is produced. The provision of the fastening surface 58, on the one hand, and of the opening edge region 54, on the other hand, as substantially uncurved structures lying in one plane leads to comparatively easy production capability, in particular of the connection unit 34.

At its axial end region remote from the fastening region 42, the circumferential wall 38 of the connection unit body 36 merges into a connection flange 62 in a connection region 60. The connection flange 62 provides a connection surface 64 completely and annularly surrounding the connection unit body center axis M. The connection surface 64 is preferably arranged in a plane orthogonal to the connection unit body center axis M and is thus equally a substantially uncurved surface against which a mating connection flange 66 provided on the heating gas generating arrangement 32 can be positioned in abutting form. For the stable connection of the heating gas generating arrangement 32, the connection flange 62 and the mating connection flange 66 can be fixedly and gas-tightly connected to each other by a connecting clamp in the form of what is referred to as a V band and surrounding the heating gas generating arrangement radially on the outside. The gas-tight connection can also be assisted, for example, by a heat-resistant sealing element positioned in the region of the two flanges 62, 66.

Figure 4:
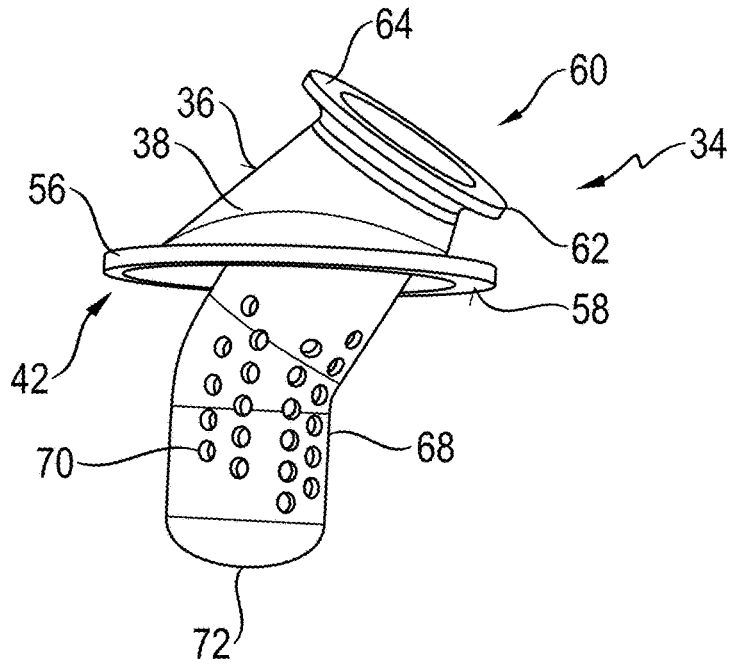
FIG. 4 shows a side view of the connection unit.
Figure 5:
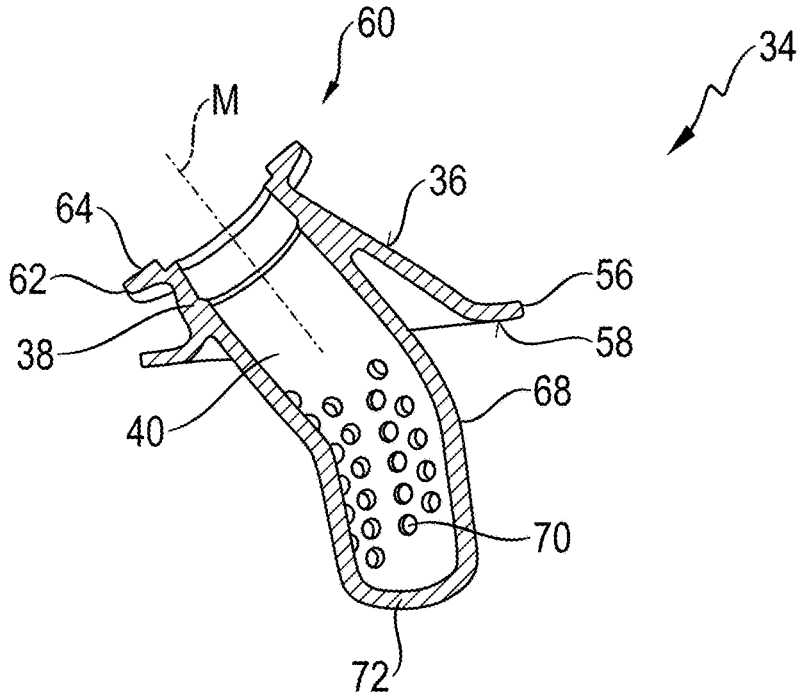
FIG. 5 shows a longitudinal sectional view of the connection unit.

In FIGS. 4 and 5 it can be seen that the fastening flange 56 with the fastening surface 58 provided thereon and the connection flange 62 with the connection surface 64 provided thereon are angled with respect to each other. This means that the fastening flange 56 or the fastening surface 58 is inclined at an angle different from 90° with respect to the connection unit body center axis. It can also be seen that the circumferential wall 38 between the connection flange 62 and the fastening flange 56 has a distance to the connection unit body center axis M which increases in the downstream direction, that is, toward the fastening flange 56. This results in the connection surface 64 being smaller than the fastening surface 58 lying at a greater distance from the connection unit body center axis M. This leads to a better load distribution in the region of the connection of the connection unit 34 to the component wall 50 and at the same time also to thermal relief.

The connection unit 34 furthermore includes a heating gas inlet pipe 68 likewise forming an integral component of the connection unit body 36 in a particularly preferred configuration. The heating gas inlet pipe is connected to the circumferential wall 38 in the region of extent thereof between the connection flange 62 and the fastening flange 56 and continues the heating gas flow duct 40 formed in the connection unit body 34. The heating gas flow duct 40 is thus substantially directly surrounded and limited in its upstream region by the circumferential wall 38 and, although it is surrounded in its downstream region formed in the heating gas inlet pipe 68 by the circumferential wall 38 which also surrounds the heating gas inlet pipe 68, it is not limited by the circumferential wall. For example, in its region extending beyond the circumferential wall 38, the heating gas inlet pipe 68 may be slightly curved, which results in a structure in which the connection unit body center axis M also has a fundamentally curved course.

In the heating gas inlet pipe 68, a multiplicity of heating gas discharge openings 70 are formed, via which the heating gas H leaving the heating gas generating arrangement 32 as exhaust gas therefrom enters the exhaust gas flow duct 28 in the interior of the exhaust gas conducting component 12. The positioning of the heating gas discharge openings 70 on the heating gas inlet pipe 68 is preferably selected such that efficient and uniform thorough mixing of heating gas H and exhaust gas A in the exhaust gas flow duct 28 is achieved. For this purpose, for example, a downstream end of the heating gas inlet pipe 68 can also be completely or substantially completely closed by an end wall 72 such that it is ensured that essentially no heating gas H is emitted from the heating gas inlet pipe 68 as a comparatively strongly focused, hot heating gas flow and as such enters the downstream connection region 18. Thus, a more uniform inflow of the downstream exhaust gas treatment unit 20 with the heating gas H or the exhaust gas A which is thoroughly mixed with the heating gas H is achieved and a local overheating of the downstream exhaust gas treatment unit 20 is avoided.

Since the heating gas H can have a comparatively high temperature of up to 1200° C., the connection unit 34 is preferably constructed from a material that is stable at such high temperatures and is also chemically resistant. Nickel-containing material, such as the nickel-based alloy marketed under the registered trademark Inconel, are particularly suitable for this purpose.

The thermal loading in particular even in the region in which the connection unit 34 connects to the exhaust gas conducting component 12 is reduced in the construction according to the disclosure by the fact that this region of the connection unit 34, which is essentially provided by the fastening region 42 or the fastening flange 56, is not acted upon or is acted upon only to a small extent directly by the comparatively hot heating gas H because of the radially expanding structure of the circumferential wall 38 and because of the provision of the heating gas inlet pipe 68. In this region, the heating gas H is conducted at a clear distance from the fastening surface 58 or the opening edge region 54, and therefore even the welded joint formed in this region between the connection unit 34 and the exhaust gas conducting component 12, which at least in this region is preferably in the form of a sheet metal formed part, is not subjected to excessively severe thermal loading. At the same time, the forces to be transmitted in this region between the connection unit 34 and the exhaust gas conducting component 12 are distributed over a comparatively large region, as a result of which the loading also generated, for example, by the deadweight of the heating gas generating arrangement 32 and exerted on the connection unit 34 via the connection region 60 is introduced into the exhaust gas conducting component 12 over a relatively large surface region, and therefore mechanical overloading in this region is also avoided.

Finally, it should be pointed out that the principles of the present disclosure can also be applied if the exhaust gas conducting component is structured differently, for example is tubular, and the spatial assignment of exhaust gas treatment units to the connection unit is selected differently than illustrated in the embodiment shown in FIG. 1. For example, the heating gas H could be introduced at a location lying upstream with respect to all of the in particular catalytically effective exhaust gas treatment units. If an exhaust gas treatment unit includes, for example, an SCR catalytic converter and, to this extent, the input of a reactant R into the exhaust gas flow is also required, the injector provided for this purpose may also be positioned at a different location than shown in the figures. For example, it could also be positioned downstream with respect to the connection unit. This also makes it possible to heat a mixer, which is assigned to the injector and is intended to assist the thorough mixing of the reactant and internal combustion engine exhaust gas, via the heating gas H and thereby assist the evaporation of the reactant R.

It is understood that the foregoing description is that of the preferred embodiments of the invention and that various changes and modifications may be made thereto without departing from the spirit and scope of the invention as defined in the appended claims.

The invention claimed is:

1. A connection unit for connecting a heating gas generating arrangement to an exhaust gas conducting component of an exhaust system for an internal combustion engine, the heating gas generated by said heating gas generating arrangement being introduceable into an exhaust gas flow duct in the exhaust gas conducting component, the connection unit comprising:

a connection unit body defining a connection unit body center axis and comprising:

a circumferential wall surrounding a heating gas flow duct;

a fastening region at one axial end region of two axial end regions of said circumferential wall for fastening to a component wall of said exhaust gas conducting component; and, a connection region at another axial end region of said two axial end regions of said circumferential wall remote from said fastening region for connecting said heating gas generating arrangement to said connection unit;

a heating gas inlet pipe being connected to said circumferential wall, being at least partially surrounded by said circumferential wall, and at least partially providing said heating gas flow duct;

wherein said connection unit body is formed integrally with said circumferential wall, said fastening region, said connection region, and said heating as inlet pipe as one material block not assembled by separate components;

wherein said fastening region includes a fastening flange protruding radially outward from said circumferential wall with respect to said connection unit body center axis and having an annular fastening surface formed on said fastening flange, said circumferential wall merging into said fastening flange of said fastening region in said one axial end region of said circumferential wall, and said connection region includes a connection flange protruding radially outward from said circumferential wall with respect to said connection unit body center axis and having an annular connection surface formed on said connection flange, said circumferential wall merging into said connection flange of said connection region in said another axial end region of said circumferential wall.

2. The connection unit of claim 1, wherein said connection unit body is formed as a metal cast body.

3. The connection unit of claim 1, wherein said heating gas flow duct has an upstream end region; and, wherein at least one of the following applies:

i) said annular connection surface is arranged substantially orthogonally with respect to said connection unit body center axis in said upstream end region of said heating gas flow duct; and, ii) said fastening surface is inclined at an angle different from 90° with respect to said connection unit body center axis in said upstream end region of said heating gas flow duct.

4. The connection unit of claim 1, wherein at least one of the following applies:

i) said annular connection surface lies in one plane; and, ii) said annular fastening surface lies in one plane.

5. The connection unit of claim 1, wherein at least one of the following applies:

i) a radial distance of said circumferential wall to said connection unit body center axis from said connection flange increases in a direction of said fastening flange; and, ii) said annular connection surface is smaller than said fastening surface.

6. The connection unit of claim 1, wherein a plurality of heating gas discharge openings are formed in said heating gas inlet pipe.

7. An exhaust system for an internal combustion engine, the exhaust system comprising:

an exhaust gas conducting component having a component wall surrounding an exhaust gas flow duct through which internal combustion engine exhaust gas can flow;

a heating gas generating arrangement for generating heating gas introduceable into said exhaust gas flow duct;

a connection unit including:

a connection unit body defining a connection unit body center axis and comprising:

a circumferential wall surrounding a heating gas flow duct;

a fastening region at one axial end region of two axial end regions of said circumferential wall for fastening to said component wall of said exhaust gas conducting component; and, a connection region at another axial end region of said two axial end regions of said circumferential wall remote from said fastening region for connecting said heating gas generating arrangement to said connection unit;

a heating gas inlet pipe being connected to said circumferential wall, being at least partially surrounded by said circumferential wall, and at least partially providing said heating gas flow duct;

wherein said connection unit body is formed integrally with said circumferential wall, said fastening region, said connection region, and said heating as inlet pipe as one material block not assembled by separate components;

wherein said fastening region includes a fastening flange protruding radially outward from said circumferential wall with respect to said connection unit body center axis and having an annular fastening surface formed on said fastening flange, said circumferential wall merging into said fastening flange of said fastening region in said one axial end region of said circumferential wall, and said connection region includes a connection flange protruding radially outward from said circumferential wall with respect to said connection unit body center axis and having an annular connection surface formed on said connection flange, said circumferential wall merging into said connection flange of said connection region in said another axial end region of said circumferential wall; and, said connecting unit being provided to connect said heating gas generating arrangement to said component wall so as to permit heating gas generated by said heating gas generating arrangement to flow through said connection unit into said exhaust gas flow duct.

8. The exhaust system of claim 7, wherein said fastening region is arranged with the fastening surface thereof covering an opening edge region of said component wall, said opening edge region surrounding a heating gas inlet opening in said component wall.

9. The exhaust system of claim 7, wherein said fastening flange is connected to said component wall via a material bond.

10. The exhaust system of claim 9, wherein said material bond is a welding.

11. The exhaust system of claim 7, wherein said component wall includes a sheet steel formed part.

12. The exhaust system of claim 7, wherein at least one of the following applies:

i) said exhaust gas conducting component provides a deflection housing for deflecting an exhaust gas flow flowing through said exhaust gas flow duct between an upstream connection region and a downstream connection region thereof; and, ii) said exhaust gas conducting component is connected to an upstream exhaust gas treatment unit in said upstream connection region and is connected to a downstream exhaust gas treatment unit in said downstream connection region.

* * * * *